US010131461B2

(12) United States Patent
Murphy

(10) Patent No.: US 10,131,461 B2
(45) Date of Patent: Nov. 20, 2018

(54) FOLDABLE PACKET FOR HOLDING A GOODS PACKAGE

(71) Applicant: The Segerdahl Corp., Wheeling, IL (US)

(72) Inventor: Brock James Murphy, Elgin, IL (US)

(73) Assignee: THE SEGERDAHL CORP., Wheeling, IL (US)

( * ) Notice: Subject to any disclaimer, the term of this patent is extended or adjusted under 35 U.S.C. 154(b) by 0 days.

(21) Appl. No.: 15/286,735

(22) Filed: Oct. 6, 2016

(65) Prior Publication Data

US 2018/0099774 A1 Apr. 12, 2018

(51) Int. Cl.

| | |
|---|---|
| ***B65D 73/00*** | (2006.01) |
| ***B65D 5/42*** | (2006.01) |
| ***B65D 75/32*** | (2006.01) |
| ***B65D 75/38*** | (2006.01) |
| ***B65D 5/54*** | (2006.01) |

(52) U.S. Cl.

CPC ..... *B65D 5/4266* (2013.01); *B65D 5/54* (2013.01); *B65D 75/326* (2013.01); *B65D 75/38* (2013.01)

(58) Field of Classification Search

CPC ..... B65D 5/4266; B65D 5/42; B65D 5/54
USPC ..... 206/472, 528, 311, 232, 570, 424, 225, 206/450, 425, 746, 474, 473, 39.7, 39, 206/39.1, 784, 37, 750, 724, 387.13; 229/314, 925, 92.8, 307, 313

See application file for complete search history.

(56) References Cited

U.S. PATENT DOCUMENTS

| | | | | | |
|---|---|---|---|---|---|
| 3,618,848 | A * | 11/1971 | Pawlowski | ..... | B65D 5/5011 206/485.1 |
| 4,870,764 | A * | 10/1989 | Boone | ..... | G09F 1/04 206/457 |
| 5,598,969 | A | 2/1997 | Ong | | |
| 6,082,612 | A | 7/2000 | Black | | |
| 6,230,964 | B1 | 5/2001 | Saito | | |
| 6,296,112 | B1 * | 10/2001 | Pettey | ..... | B65D 85/546 206/232 |
| 7,153,254 | B2 | 12/2006 | Cordes | | |
| 8,046,940 | B2 | 11/2011 | Jones et al. | | |
| 8,132,672 | B2 | 3/2012 | Ganti | | |
| 8,898,938 | B2 | 12/2014 | Stone | | |
| 8,898,939 | B2 * | 12/2014 | Kibbe | ..... | B42D 15/045 206/101 |
| 2003/0127344 | A1 * | 7/2003 | Block | ..... | B65D 5/4237 206/232 |
| 2007/0113432 | A1 | 5/2007 | Poole | | |
| 2011/0084119 | A1 | 4/2011 | Zapalac | | |

* cited by examiner

*Primary Examiner* — Rafael Ortiz

(74) *Attorney, Agent, or Firm* — Klintworth & Rozenblat IP LLP

(57) ABSTRACT

A packet according to some embodiments of the disclosure is provided for holding a goods package. The packet includes first and second panels which are secured together to form an open-ended pocket. The first panel has an aperture therethrough which is partially overlapped by the second panel. The goods package seats within the open-ended pocket with a protrusion of the goods package extending through the aperture. The engagement of the protrusion though the aperture locks the goods package to the packet.

7 Claims, 8 Drawing Sheets

FOLDABLE PACKET FOR HOLDING A GOODS PACKAGE

FIELD OF THE DISCLOSURE

The present disclosure relates to a packet for holding a goods package.

BACKGROUND

Packets are known in the prior art for holding goods, such as pills. The packet may be made out one or more of sheets whose surfaces have several permanent pockets, formed by sewing, sealing, gluing, etc., with each capable of holding snugly, securely, one or more flexible pouches to contain small items such as pills. The pill-pouch-pocket-packet packet can be folded, and then securely closed with buttons, zippers, "hook and loop" devices, etc., and, as needed opened to easily remove any pouch to dispense its contents if it has any, or if the pouch is empty, fill it with small items such as pills.

This approach is not highly suitable for providing a sample of the pill with associated advertising materials. The present disclosure provides a packet which overcomes the problems of the prior art.

SUMMARY

A packet according to some embodiments of the disclosure is provided for holding a goods package. The packet includes first and second panels formed of paper or cardboard which are secured together to form an open-ended pocket. The first panel has an aperture therethrough which is partially overlapped by the second panel. The goods package seats within the open-ended pocket with a protrusion of the goods package extending through the aperture. The engagement of the protrusion though the aperture locks the goods package to the packet.

This Summary is provided merely for purposes of summarizing some example embodiments so as to provide a basic understanding of some aspects of the disclosure. Accordingly, it will be appreciated that the above described example embodiments are merely examples and should not be construed to narrow the scope or spirit of the disclosure in any way. Other embodiments, aspects, and advantages of various disclosed embodiments will become apparent from the following detailed description taken in conjunction with the accompanying drawings which illustrate, by way of example, the principles of the described embodiments.

BRIEF DESCRIPTION OF THE DRAWINGS

The organization and manner of the structure and operation of the disclosed embodiments, together with further objects and advantages thereof, may best be understood by reference to the following description, taken in connection with the accompanying drawings, which are not necessarily drawn to scale, wherein like reference numerals identify like elements in which.

DETAILED DESCRIPTION

Figure 1:
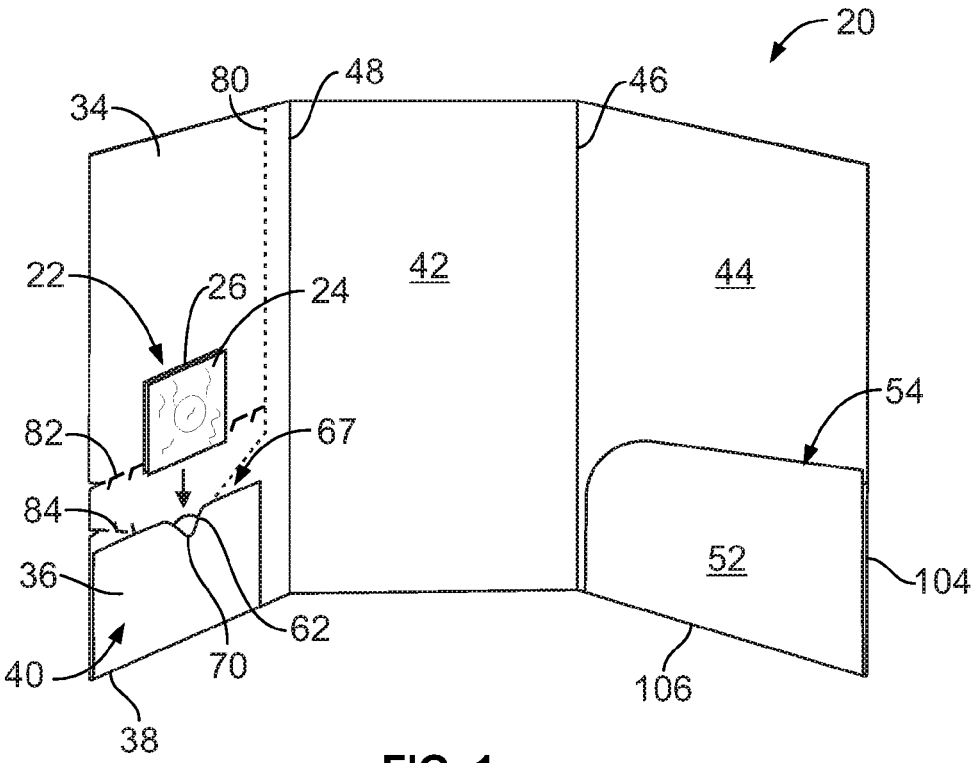
FIG. 1 is a perspective view of a packet which incorporates the features of the present disclosure in an open condition.
Figure 2:
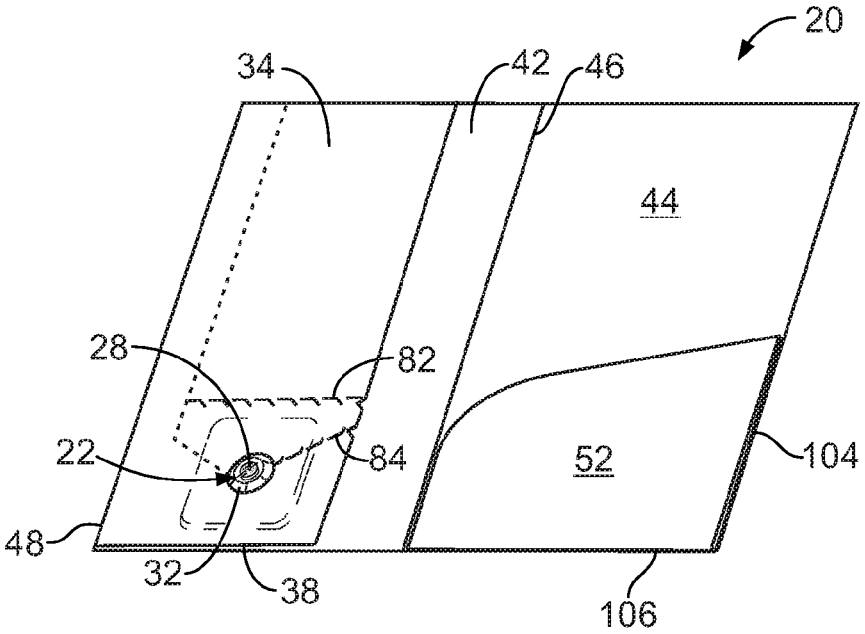
FIG. 2 is a perspective view of the packet in a partially folded condition.
Figure 3:
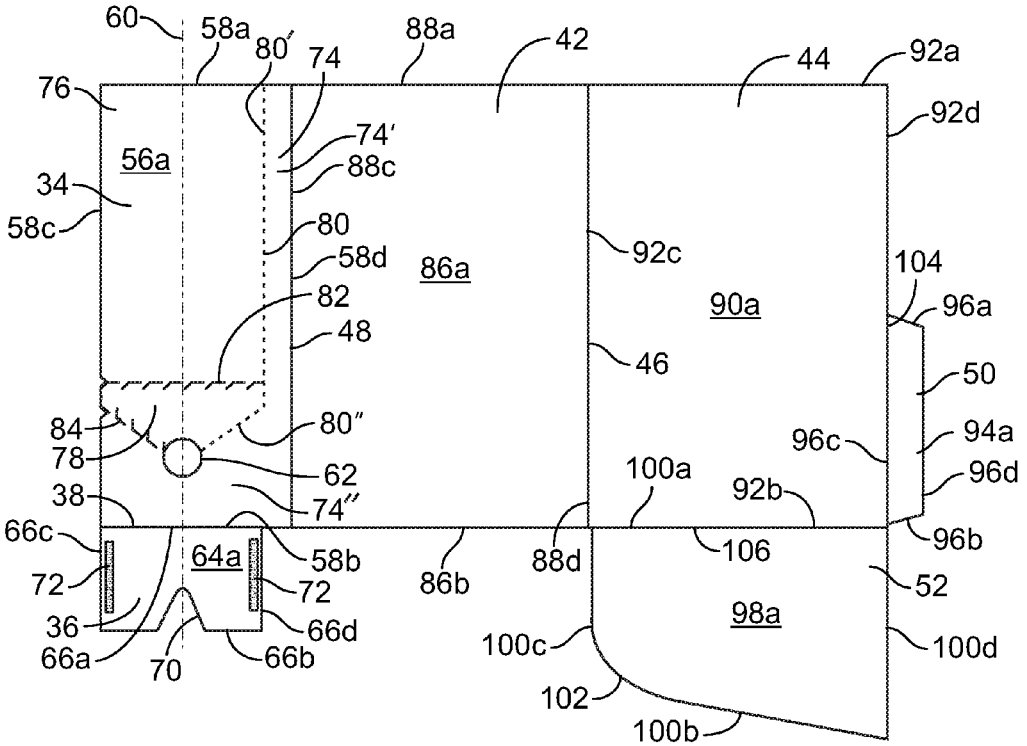
FIG. 3 is a top plan view of the blank that is used to form the packet, which shows fold lines and perforation lines.
Figure 4:
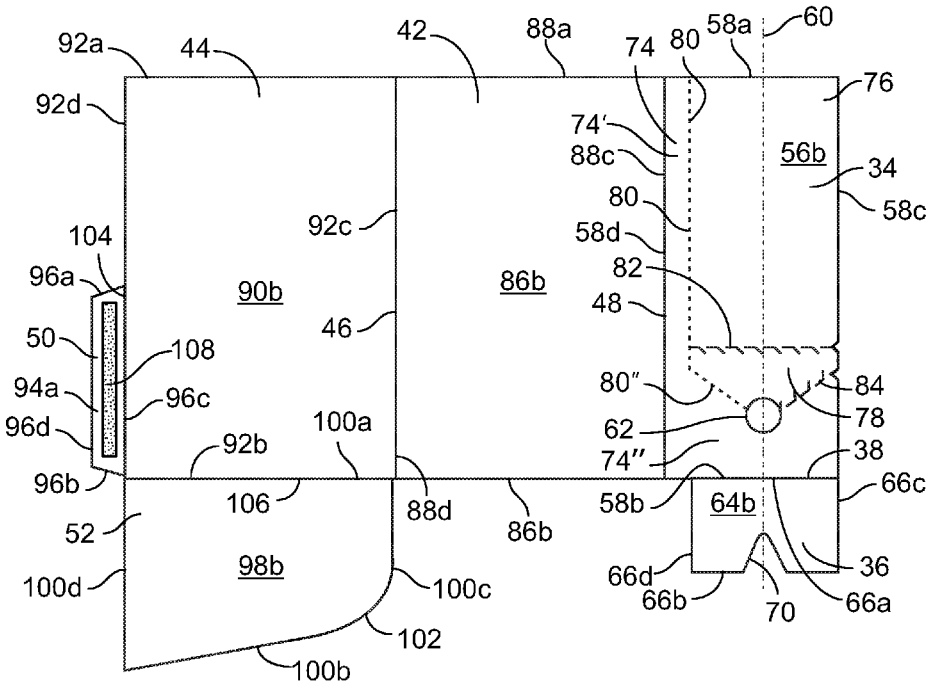
FIG. 4 is a bottom plan view of the blank that is used to form the packet, which shows fold lines and perforation lines.

While the disclosure may be susceptible to embodiment in different forms, there is shown in the drawings, and herein will be described in detail, a specific embodiment with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

A packet 20 for holding a goods package 22 is provided. The packet 20 is comprised of paper or cardboard stock. In an embodiment, the packet 20 is formed of a single sheet of material.

The goods package 22 is formed from a first planar layer 24 having a secondary layer 26 attached thereto. The second layer 26 is generally planar, with the exception of a protrusion 28 extending therefrom, which forms a pocket between the first layer 24 and the second layer 26 for acceptance of goods 32 therein. In an embodiment, the protrusion 28 is convex. In an embodiment, the protrusion 28 is centrally located on the goods package 22. The goods 32, such as a pill, seats within the pocket formed by the protrusion 28. The goods 32 can be removed from the goods package 22 for use or consumption by a consumer.

The packet 20 includes first and second panels 34, 36 which are separated from each other by a fold line 38. The first and second panels 34, 36 form an open-ended goods holding pocket 40 and is used to hold the goods package 22 therein. When the goods package 22 is inserted into the goods holding pocket 40, the goods package 22 is held in a "locked" configuration as discussed herein. In an embodiment, the packet 20 further includes third and fourth panels 42, 44 which are separated from each other by a fold line 46, such that a folder is formed by the packet 20. In an embodiment, the first panel 34 is attached to the third panel 42 by a fold line 48. As shown, the first, second and third panels 34, 36, 42 form a right side of the folder and the fourth panel 44 forms a left side of the folder when the packet 20 is an open condition and the consumer is looking at the packet 20. In an embodiment, fifth and sixth panels 50, 52 are provided to form a second open-ended pocket 54 in the packet 20. In an embodiment, the panels 34, 36, 42, 44 are rectangular. The panels 34, 36, 42, 44 may take other shapes than rectangular.

The first panel 34 is planar and has first and second surfaces 56*a*, 56*b* which are defined by first and second edges 58*a*, 58*b*, a third edge 58*c* extending between the first and second edges 58*a*, 58*b* at the ends of the first and second edges 58*a*, 58*b*, and a fourth edge 58*d* extending between the first and second edges 58*a*, 58*b* at the opposite ends of the first and second edges 58*a*, 58*b*. The first and second edges 58*a*, 58*b* define a width of the first panel 34; the third and fourth edges 58*c*, 58*d* define a length of the first panel 34. A centerline 60 of the first panel 34 is defined along the length and runs parallel to the third and fourth edges 58*c*, 58*d*. In an embodiment, the first and second edges 58*a*, 58*b* are parallel to each other and the third and fourth edges 58*c*, 58*d* are parallel to each other and perpendicular to the first and second edges 58*a*, 58*b*.

The first panel 34 has an aperture 62 therethrough. In an embodiment, the aperture 62 is proximate to, but spaced from, the second edge 58*b*. The aperture 62 may take a variety of shapes. In an embodiment and as shown, the aperture 62 is circular.

The second panel 36 is planar and has first and second surfaces 64*a*, 64*b* which are defined by first and second edges 66*a*, 66*b*, a third edge 66*c* extending between the first and second edges at the ends of the first and second edges 66*a*, 66*b*, and a fourth edge 66*d* extending between the first and second edges 66*a*, 66*b* at the opposite ends of the first and second edges 66*a*, 66*b*. The first and second edges 66*a*, 66*b* define a width of the second panel 36; the third and fourth edges 66*c*, 66*d* define a length of the second panel 36. In an embodiment, the first and second edges 66*a*, 66*b* are parallel to each other and the third and fourth edges 66*c*, 66*d* are parallel to each other and perpendicular to the first and second edges 66*a*, 66*b*.

The second panel 36 has a length which is less than the length of the first panel 34. In an embodiment, the second panel 36 has a length which is substantially less than the length of the first panel 34.

In an embodiment, a cutout 70 extends along a portion of the length and width of the second panel 36 from the second edge 66*b* toward the first edge 66*a*. The cutout 70 may take a variety of shapes. In an embodiment as shown, the cutout 70 is generally V-shaped.

The first panel 34 is attached to the second panel 36 at the fold line 38 which is at the second edge 58*b* of the first panel 34 and at the first edge 66*a* of the second panel 36. When the second panel 36 is folded onto the first panel 34, the first surface 64*a* of the second panel 36 faces the first surface 56*a* of the first panel 34. The second panel 36 is further attached to the first panel 34 at edges 66*c* and 66*d* to form the open-ended goods holding pocket 40. The second panel 36 is not attached to the first panel 34 along edge 66*b* such that an opening 67 is formed into the open-ended goods holding pocket 40. In an embodiment, the second panel 36 is attached to the first panel 34 by adhesive 72 provided on the surfaces 56*a*, 64*a* proximate to the third edges 58*c*, 66*c*, and adhesive 72 is provided on the surfaces 56*a*, 64*a* proximate to the fourth edges 58*d*, 66*d*. During formation of the packet 20, the adhesive 72 may be applied to either or both of the surface 56*a* of the first panel 34 and the surface 64*a* of the second panel 36. While the packet 20 is shown with the second panel 36 extending from the second edge 58*b* of the first panel 34, the second panel 36 could instead extend from the third edge 58*c* of the first panel 34 with the fold line 38 therebetween, and this second panel 36 secured to the first panel 34 along edges 58*a*/66*a* and edges 58*b*/66*b*, with edge 66*d* not being secured to the first panel 34 to form the opening 67.

When folded, the second panel 36 completely or partially overlaps the aperture 62 in the first panel 34. In an embodiment and as shown, the second panel 36 partially overlaps the aperture 62 in the first panel 34 and the cutout 70 partially exposes the aperture 62.

In an embodiment, the second panel 36 does not extend along the entire width of the first panel 34. In other embodiments, the second panel 36 extends along the entire width of the first panel 34.

In an embodiment, the first panel 34 is separated into a first panel section 74, a second panel section 76 and a third panel section 78 by perforation/score lines 80, 82, 84. The first panel section 74 has a first portion 74' which extends between the edges 58*a*, 58*b* and between the edge 58*d* and the second and third panel sections 76, 78, and a second portion 74" which extends from the first portion 74' and between the third panel section 78 and the second edge 58*b*. The second panel section 76 extends between the first edge 58*a* and the third panel section 78 and between the first portion 74' of the first panel section 74 and the third edge 58*c*. The third panel section 78 extends between the second panel section 76 and the second portion 74" of the first panel section 74, and extends between the and the third edge 58*c* and the first portion 74' of the first panel section 74. The perforation/score line 80 separates the first panel section 74 from the second and third panel sections 76, 78. The perforation/score line 80 commences at the first edge 58*a* and terminates at the aperture 62. In an embodiment, the perforation/score line 80 has a linear portion 80' which commences at the first edge 58*a* and extends toward the second edge 58*b* and an angled portion 80" which commences at the end of the linear portion 80' and extends to the aperture 62. In an embodiment, the linear portion 80' is parallel to, but offset from, the centerline 60 of the first panel 34. The angled portion 80" is angled relative to the centerline 60 of the first panel 34 and relative to the linear portion 80'. In an embodiment, the angled portion 80" is angled at 45 degrees relative to the centerline 60 and to the linear portion 80'. The perforation/score line 82 separates the second panel section 76 from the third panel section 78 and extends along a portion of the width of the first panel 34. The perforation/score line 82 commences at the third edge 58*c* of the first panel 34 and meets with the linear portion 80' of the perforation/score line 80 at its opposite end. In an embodiment, the perforation/score line 82 is perpendicular relative to the centerline 60 of the first panel 34 and relative to the linear portion 80' of the perforation/score line 80. The perforation/score line 84 separates the third panel section 78 from the second portion 74" of the first panel section 74 and extends along a portion of the width of the first panel 34. The perforation/score line 84 commences at the third edge 58*c* of the first panel 34 and meets with the aperture 62 at its opposite end. In an embodiment, the perforation/score line 82 and the perforation/score line 84 are spaced apart from each other along the third edge 58*c* of the first panel 34. In an embodiment, the second panel section is rectangular. In an embodiment, the third panel section 78 is triangular.

In an embodiment, the adhesive 72 does not overlap the perforation lines 84, 80.

The third panel 42 is planar and has first and second surfaces 86*a*, 86*b* which are defined by first and second edges 88*a*, 88*b*, a third edge 88*c* extending between the first and second edges 88*a*, 88*b* at the ends of the first and second edges 88*a*, 88*b*, and a fourth edge 88*d* extending between the first and second edges 88*a*, 88*b* at the opposite ends of the first and second edges 88*a*, 88*b*. The first and second edges 88*a*, 88*b* define a width of the third panel 42; the third and fourth edges 88*c*, 88*d* define a length of the third panel 42. In an embodiment, the first and second edges 88*a*, 88*b* are parallel to each other and the third and fourth edges 88*c*, 88*d* are parallel to each other and perpendicular to the first and second edges 88*a*, 88*b*.

The fourth panel 44 is planar has first and second surfaces 90*a*, 90*b* which are defined by first and second edges 92*a*, 92*b*, a third edge 92*c* extending between the first and second edges 92*a*, 92*b* at the ends of the first and second edges 92*a*, 92*b*, and a fourth edge 92*d* extending between the first and second edges 92*a*, 92*b* at the opposite ends of the first and second edges 92*a*, 92*b*. The first and second edges 92*a*, 92*b* define a width of the fourth panel 44; the third and fourth edges 92*c*, 92*d* define a length of the fourth panel 44. In an embodiment, the first and second edges 92*a*, 92*b* are parallel to each other and the third and fourth edges 92*c*, 92*d* are parallel to each other and perpendicular to the first and second edges 92*a*, 92*b*.

The third and fourth panels 42, 44 are attached to each other along the fold line 46 which is provided at the fourth edge 88*d* of the third panel 42 and at the third edge 92*c* of the fourth panel 44. In an embodiment, the third and fourth panels 42, 44 have the same lengths and widths. In an embodiment, the third and fourth panels 42, 44 have the differing lengths and widths. When the third and fourth panels 42, 44 are folded onto each other into a folded condition, the first surfaces 90*a*, 86*a* face each other.

The first and third panels 34, 42 are attached to each other along the fold line 48 which is provided at the fourth edge 58*d* of the first panel 34 and at the third edge 88*c* of the third panel 42. When the first and second panels 34, 36 are folded onto the third panel 42, the surfaces 56*a*, 64*b* of the first and second panels 34, 36 face the surface 86*a* of the third panel 42. When the first and second panels 34, 36 are folded onto the third panel 42 and then the fourth panel 44 is folded onto the third panel 42, the surface 90*a* of the fourth panel 42 faces the surface 56*b* of the first panel 34 and the surface 86*a* of the third panel 42.

In an embodiment, the first and third panels 34, 42 have the differing lengths and widths. In an embodiment, the first and third panels 34, 42 have the same lengths and widths.

In an embodiment, the first edges 58*a*, 88*a*, 92*a* are aligned with each other and in some embodiments, the first edges 58*a*, 88*a*, 92*a* form a straight line. In an embodiment, when the first and second panels 34, 36 are folded onto the third panel 42 and then the fourth panel 44 is folded onto the third panel 42, the edges 58*b*, 66*a*, 88*b* and 92*b* are aligned with each other and in some embodiments, the edges 58*b*, 66*a*, 88*b* and 92*b* form a straight line.

In an embodiment, the fourth panel 44 includes the open-ended pocket 54 attached thereto. In such embodiments, the open-ended pocket 54 is formed of the fifth and sixth panels 50, 52.

The fifth panel 50 forms a flap and is planar. The fifth panel 50 has first and second surfaces 94*a*, 94*b* which are defined by first and second edges 96*a*, 96*b*, a third edge 96*c* extending between the first and second edges 96*a*, 96*b* at the ends of the first and second edges 96*a*, 96*b*, and a fourth edge 96*d* extending between the first and second edges 96*a*, 96*b* at the opposite ends of the first and second edges 96*a*, 96*b*. The first and second edges 96*a*, 96*b* define a width of the fifth panel 50; the third and fourth edges 96*c*, 96*d* define a length of the fifth panel 50. In an embodiment, the first and second edges 96*a*, 96*b* are generally parallel to each other and the third and fourth edges 96*c*, 96*d* are parallel to each other and generally perpendicular to the first and second edges 96*a*, 96*b*.

The sixth panel 52 is planar and has first and second surfaces 98*a*, 98*b* which are defined by first and second edges 100*a*, 100*b*, a third edge 100*c* extending between the first and second edges 100*a*, 100*b* at the ends of the first and second edges 100*a*, 100*b*, and a fourth edge 100*d* extending between the first and second edges 100*a*, 100*b* at the opposite ends of the first and second edges 100*a*, 100*b*. The first and second edges 100*a*, 100*b* define a width of the sixth panel 52; the third and fourth edges 100*c*, 100*d* define a length of the sixth panel 52. In an embodiment, the first and second edges 100*a*, 100*b* are generally parallel to each other, the third and fourth edges 100*c*, 100*d* are parallel to each other, the third edge 100*c* is perpendicular to the first edge 100*a*, the third edge 100*c* is generally perpendicular to the second edge 100*b*, the fourth edge 100*d* is perpendicular to the first edge 100*a*, the fourth edge 100*d* is generally perpendicular to the second edge 100*b*, the the first and second edges 100*a*, 100*b*, and a rounded corner 102 is provided between the second and third edges 100*b*, 100*c*.

In an embodiment, the fifth panel 50 has a width which may be substantially less than the width of the sixth panel 52 and the width of the fourth panel 44. In an embodiment, the sixth panel 52 has a width which is less than the width of the fourth panel 44.

The fifth panel 50 is folded over onto the third panel 44 along fold line 104. When folded, the surface 94*a* of the fifth panel 50 faces the surface 90*a* of the fourth panel 44. The sixth panel 52 is then folded over onto the fifth panel 50 along fold line 106 and the panels 50, 52 are secured together by adhesive 108 between surface 94*b* of the fifth panel 50 and the surface 98*a* proximate to the edge 100*d* of the sixth panel 52. The edge 100*b* of the sixth panel 52 is only secured to the fifth panel 50 where the panels 50, 52 overlap such that the majority of the edge 100*b* is not secured to the fifth panel 50 or to the third panel 44. The edge 100*c* of the sixth panel 52 is not secured to the fifth panel 50 or to the third panel 44. This forms the open-ended pocket 54. A consumer can pull the sixth panel 52 away from the third panel 42 to insert materials into the open-ended pocket 54. In an embodiment, the third edge 100*c* of the sixth panel 52 is attached to the fourth panel 44.

While the open-ended pocket 54 is shown and described as being on the fourth panel 44, it is to be understood that the open-ended pocket 54 could instead be provided on third panel 42, the open-ended pocket 54 could be eliminated, or an open-ended pocket 54 may be provided on both of the third and fourth panels 42, 44.

While third and fourth panels 42, 44 are provided, these panels 42, 44 can be eliminated such that the packet 20 is only formed of the first and second panels 34, 36.

FIGS. 6-14 show an example embodiment of the formation of the packet 20.

Figure 5:
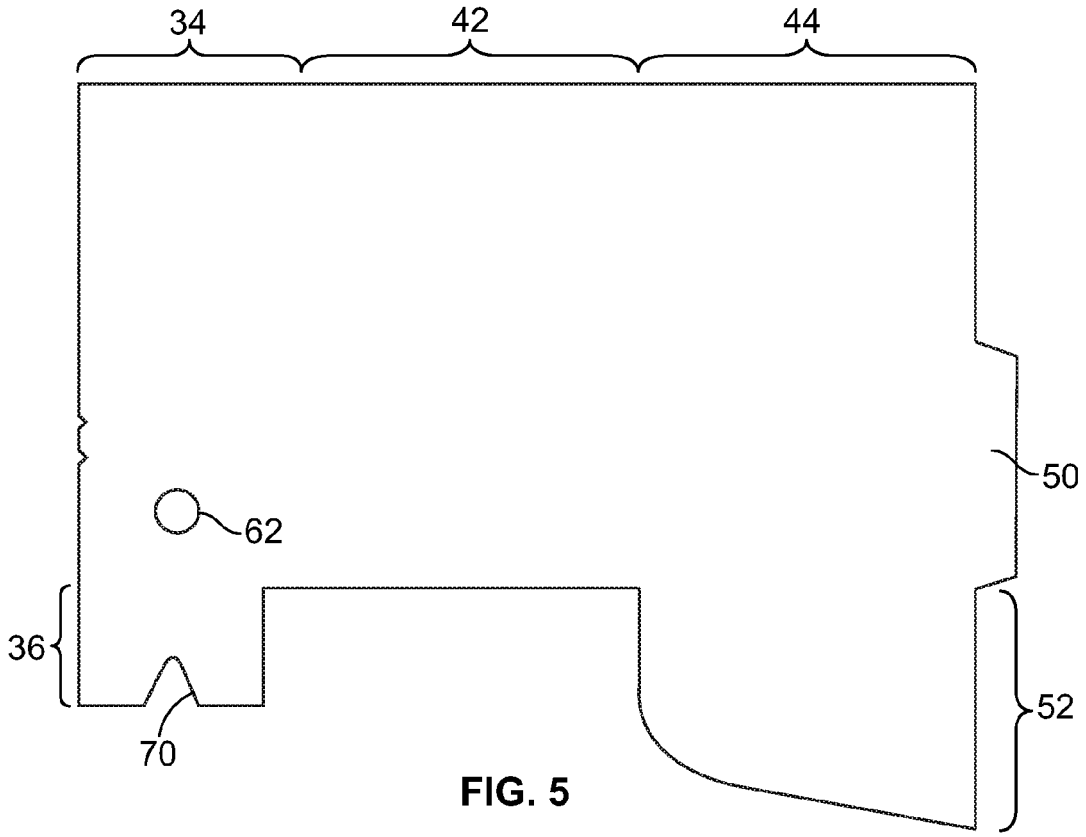
FIG. 5 is a top plan view of the blank as initially cut from stock in an initial step to form the packet.
Figure 6:
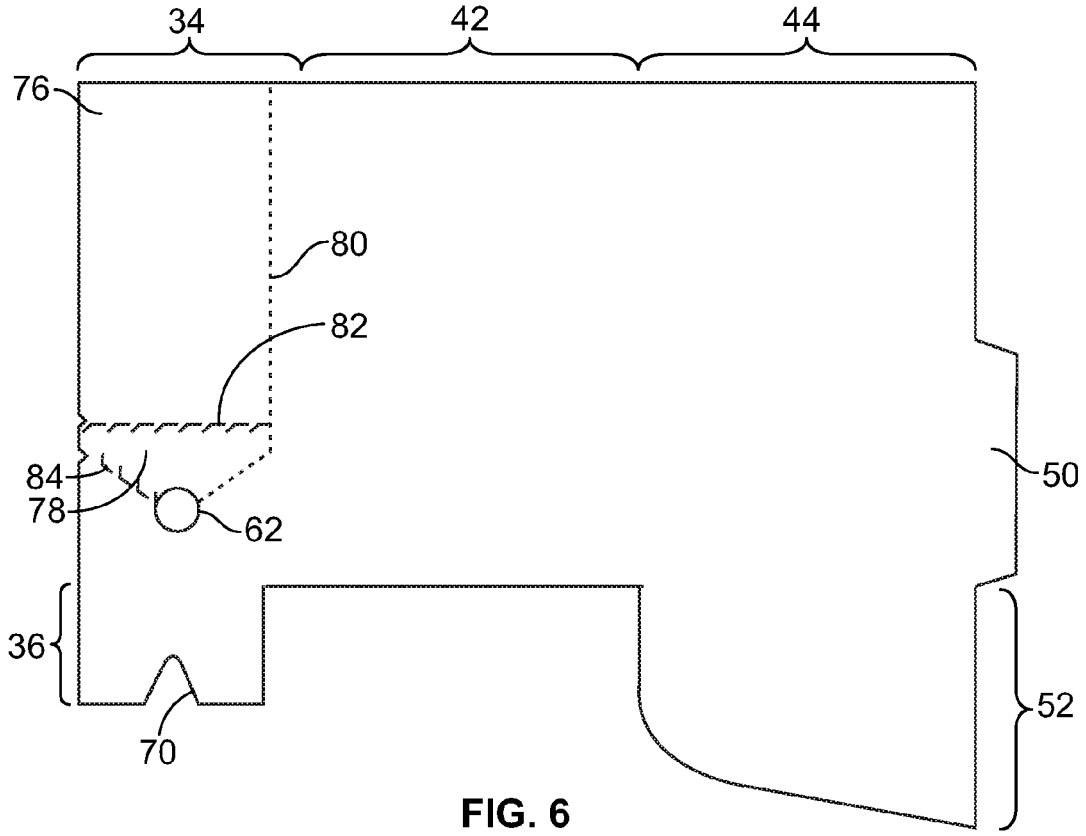
FIGS. 6-14 are top plan views of the blank showing the steps taken to form the packet from the blank of FIG. 5.
Figure 7:
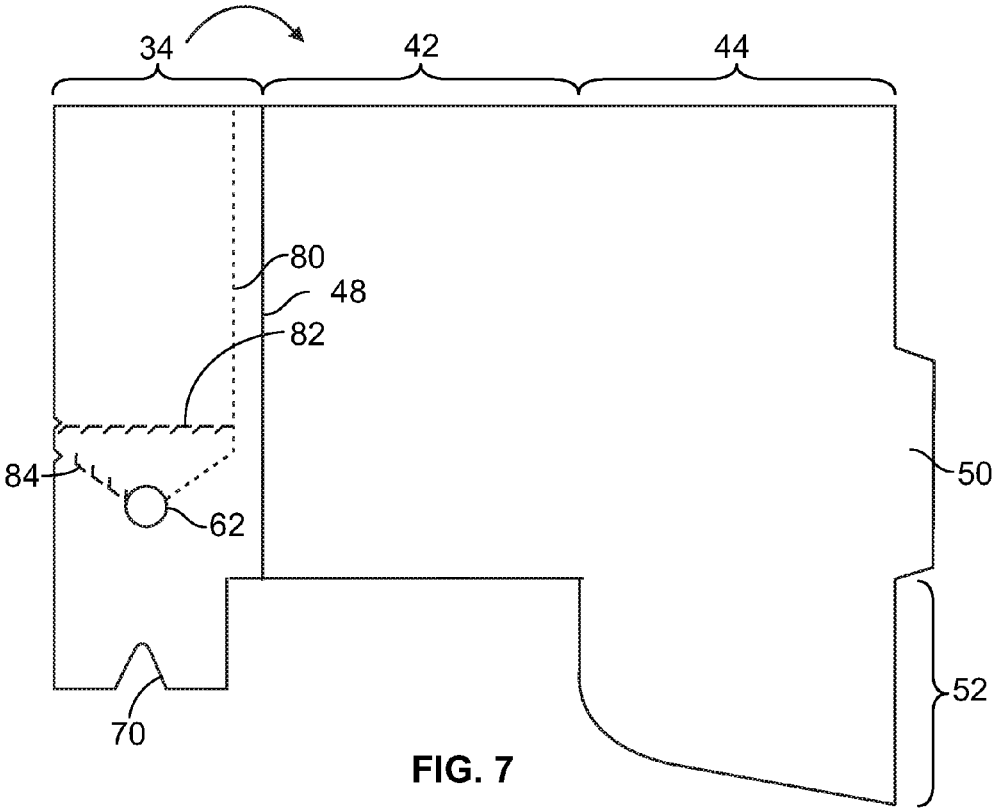
Figure 8:
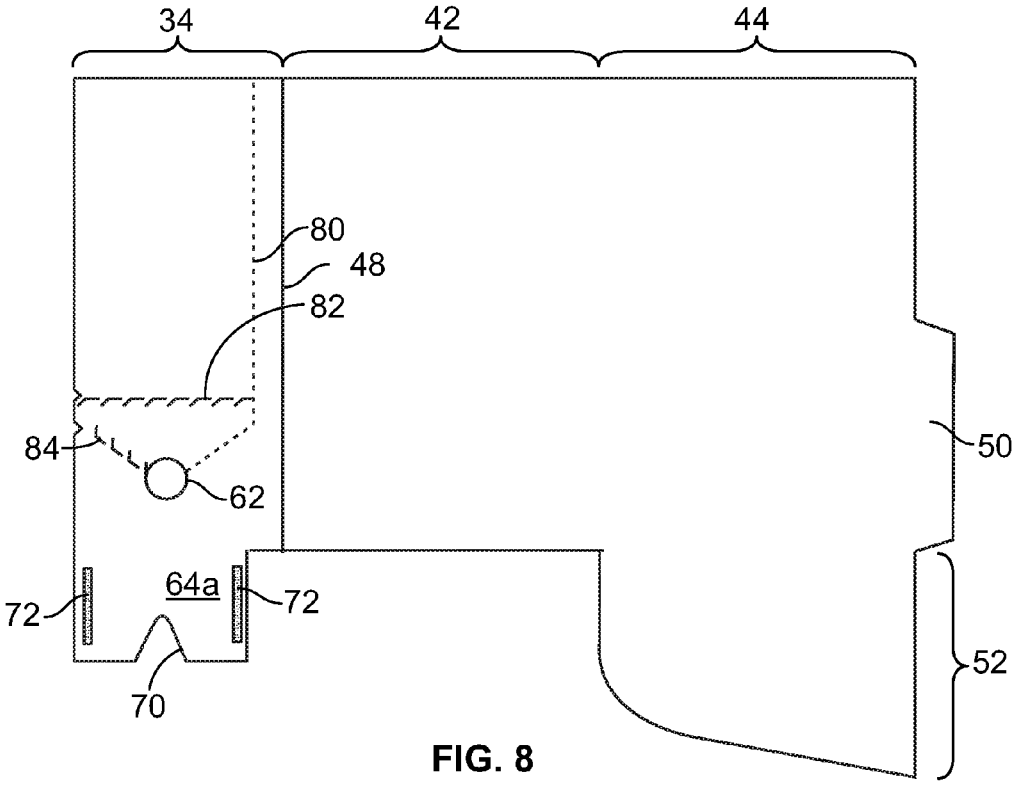
Figure 9:
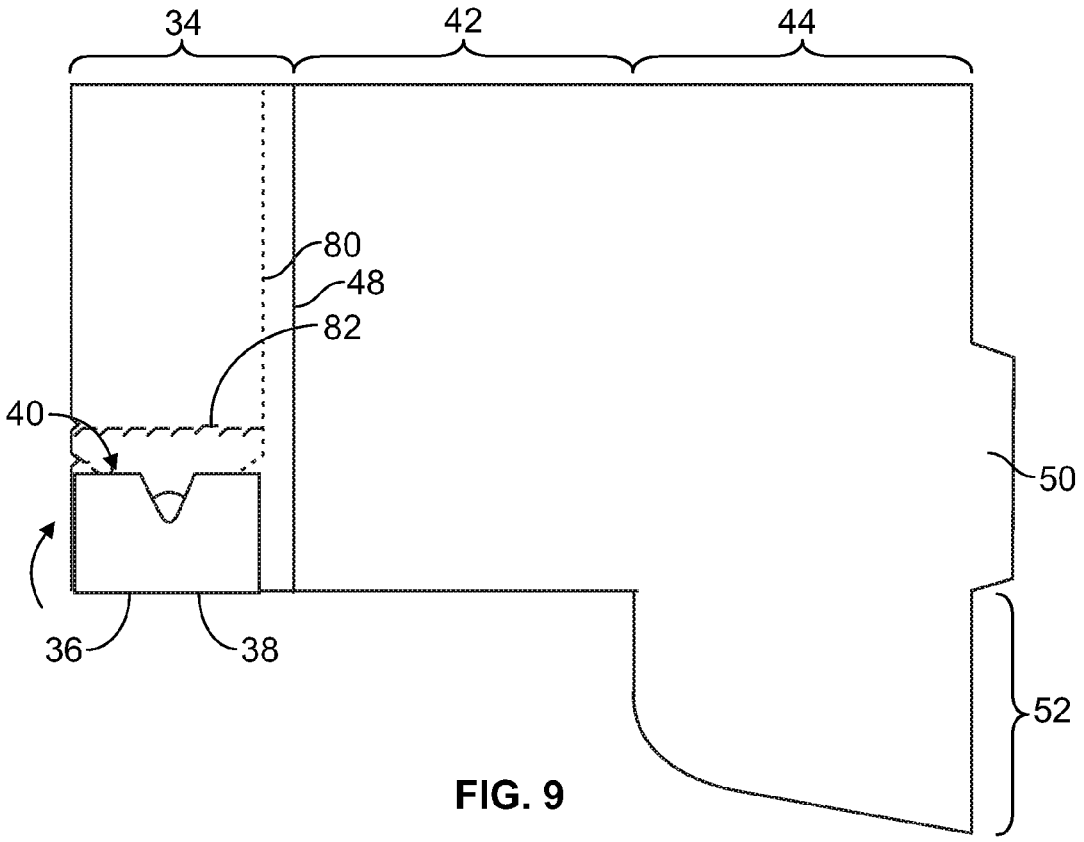
Figure 10:
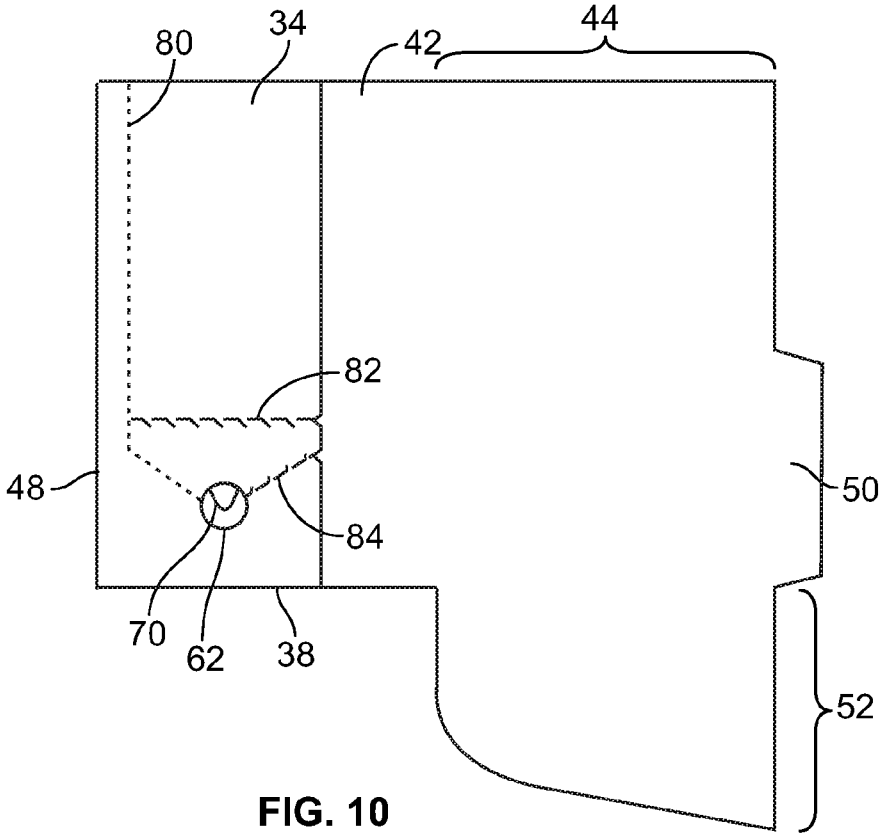
Figure 11:
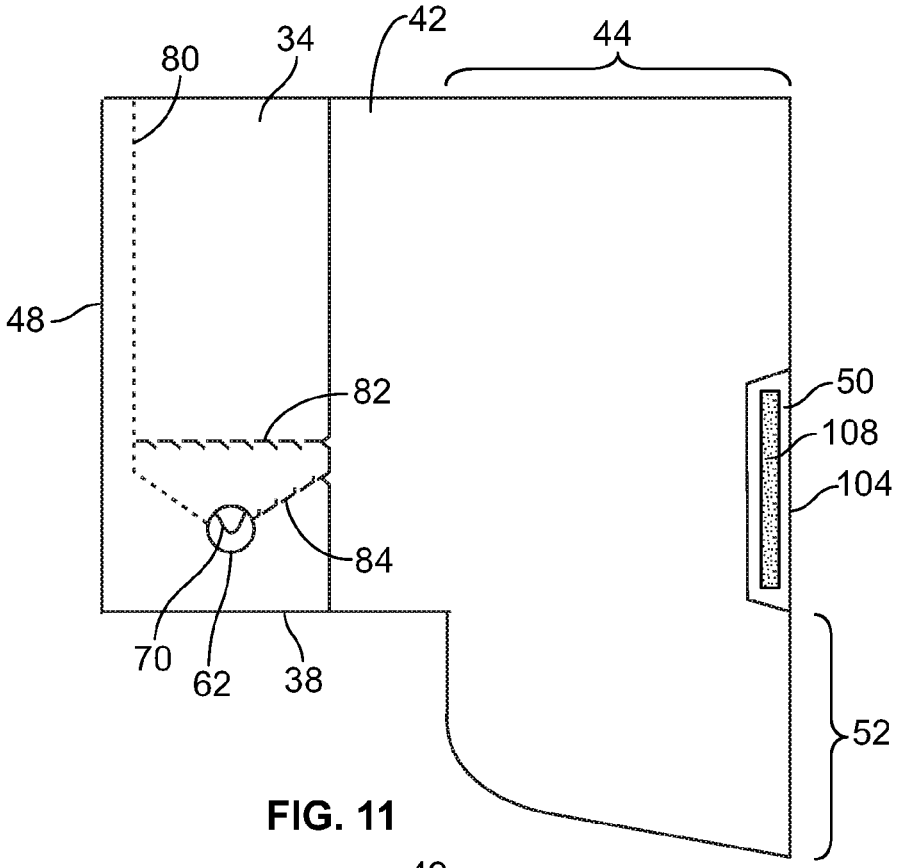
Figure 12:
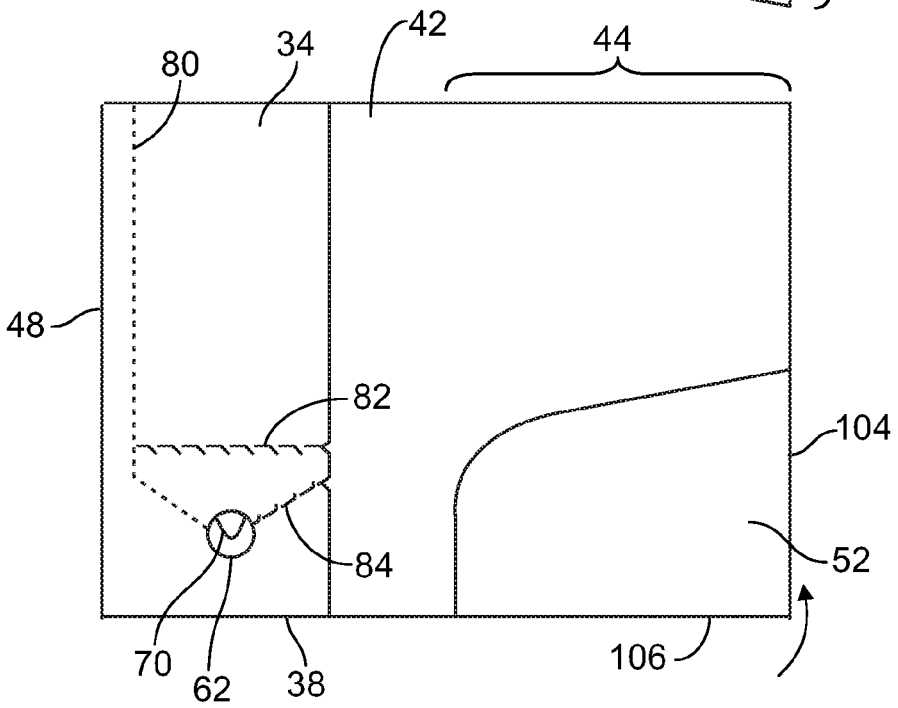
Figure 13:
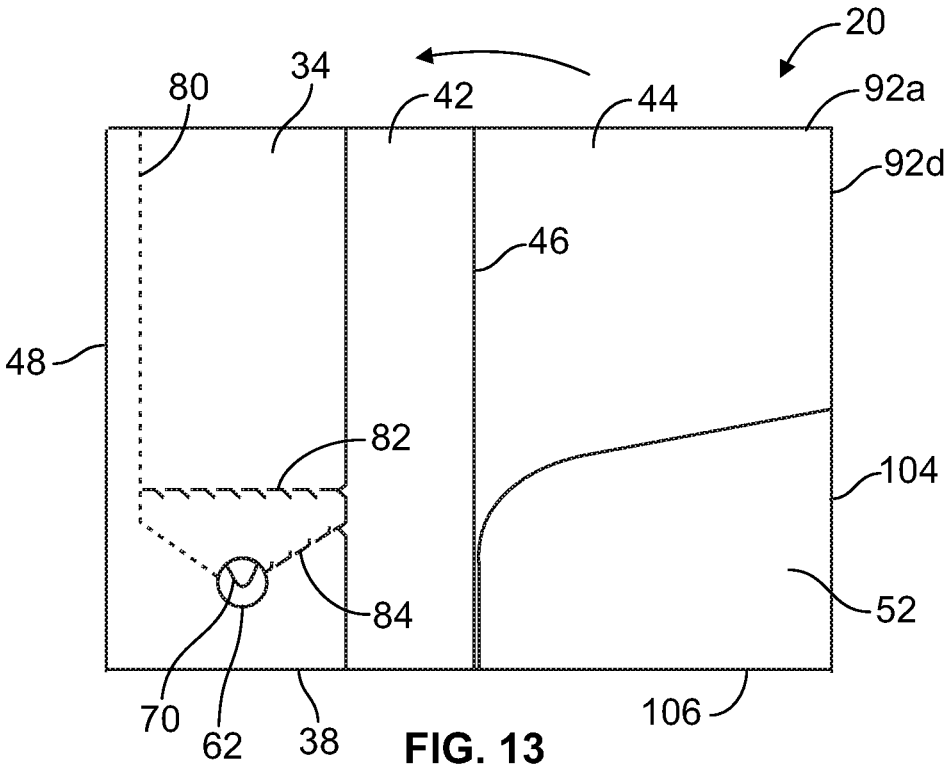
Figure 14:
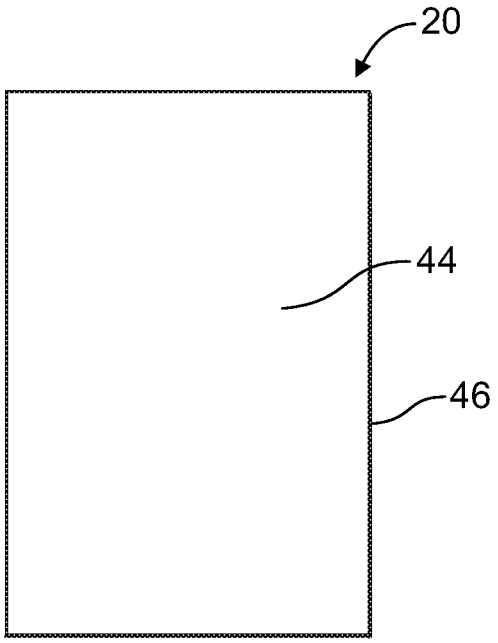

To form the packet 20, the blank is cut from stock as shown in FIG. 5. As shown in FIG. 6, the blank is then perforated to form the perforation/score lines 80, 82, 84. As shown in FIG. 7, the first panel 34/second panel 36 are folded along fold line 48 onto the third panel 42 such that the surfaces 56*a*, 64*b* face surface 86*a*. As shown in FIG. 8, adhesive 72 is applied to surface 64*a* proximate to the edges 66*c*, 66*d* of the second panel 36 and/or to surface 56*a* proximate to the edges 58*c*, 58*d* of the first panel 34 where the second panel 36 will overlap. During formation of the packet 20, the adhesive 72 may be applied to either or both of the first panel 34 and the second panel 36. As shown in FIG. 9, the second panel 36 is folded over the first panel 34 along fold line 38 such that the surface 64*a* faces surface 56*a*, and is secured to the first panel 34 by the adhesive 72 to form the open-ended goods holding pocket 40. As shown in FIG. 9, the first panel 34/second panel 36 are folded along fold line 48 onto the third panel 42 such that the surfaces 56*a*, 64*b* face surface 86*a*. As shown in FIG. 11, the fifth panel 50 is folded over the first panel 34 along fold line 104 such that the surface 94*a* faces surface 90*a* and adhesive 108 is applied to the second surface 94*b* of the fifth panel 50. As shown in FIG. 12, the sixth panel 52 is then folded over the third panel 44 and the fifth panel 50 along fold line such that surface 98*a* faces surfaces 94*b* and 90*a*, and is secured to the fifth panel 50 by the adhesive 108. As shown in FIGS. 13 and 14, the fourth panel 44/fifth panel 50/sixth panel 52 are then folded over the third panel 42 along fold line 46 such that surfaces 90*a*, 98*b* face surfaces 86*a* and 56*b* to form the completed packet 20.

While FIGS. 6-14 show an example embodiment of the formation of the packet 20, it is to be understood that the order of formation can be changed or steps can be eliminated. For example, the fold line 48 can be formed after the second panel 36 is folded onto first panel 34. For example, fold line 106 could be formed first.

In use, a consumer inserts the goods package 22 through the opening 67 and into the goods holding pocket 40 such that the protrusion 28 of the goods package 22 extends through the aperture 62 and the first layer 24 abuts against the first surface 64*a* of the second panel 36, and the second layer 26 which surrounds the protrusion 28 abuts against the first surface 56*a* of the first panel 34. The panels 34, 36 can flex sufficiently to allow the goods package 22 to be inserted into the goods holding pocket 40. In an embodiment, the aperture 62 is sized to be slightly larger than the protrusion 28 of the goods package 22. When the panels 34, 36 return to their unflexed condition, since the protrusion 28 extends through the aperture 62, this "locks" the goods package 22 into place in the packet 20 since the engagement of the protrusion 28 though the aperture 62 prevents the goods package 22 from easily sliding out of the goods holding pocket 40 and the layers 24, 26 are sandwiched between the first and second layers 24, 26.

The perforation/score lines 80, 82, 84 allow a consumer to easily tear the third panel section 78 away from the second and third panel sections 76, 78 of the first panel 34 to easily release the goods package 22 from the packet 20.

While the packet 20 is shown is as being a tri-fold packet 20 having three panels 34/36, 42, 44, the packet 20 may be only a single panel 34/36 (such that the third and fourth panels 42, 444 are eliminated) to form the goods holding pocket 40. Alternatively, the packet 20 may only have two panels, for example the third panel 42 is eliminated and the fourth panel 44 is joined to the first panel 34 at the fold line 48.

The packet 20 can have indicia, such words, illustrations, photographs, artwork, etc., on any of the surfaces of any of the panels.

While a single sheet is described to form the packet 20, multiple sheets could be provided and bonded together.

While adhesive 72, 108 is shown and described, it is to be understood that the adhesive 72, 108 could be replaced by other means for joining the panels together, such as staples.

In addition, while the fold lines are not described as being perforated, any of the fold lines may be perforated.

While a particular embodiment is illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

What is claimed is:

1. A combination comprising:

a goods package comprising a planar portion and a protruding portion, and a goods seated between the planar portion and a protruding portion;

a packet comprising a first panel formed of paper or cardboard having first and second surfaces defined by first and second edges, a third edge extending between the first and second edges at the ends of the first and second edges, and a fourth edge extending between the first and second edges at the opposite ends of the first and second edges, and an aperture provided through the first panel and spaced from each edge thereof, wherein a length of the first panel is defined between the first and second edges, and a second panel formed of paper or cardboard having first and second surfaces defined by first and second edges, a third edge extending between the first and second edges at the ends of the first and second edges, and a fourth edge extending between the first and second edges at the opposite ends of the first and second edges, the first, third and fourth edges of the second panel secured to the first panel, such that the second edge is not secured to the first panel to form an open ended pocket, the second panel overlapping at least a portion of the aperture, wherein a length of the second panel is defined between the first and second edges, the length of the second panel being less than the length of the first panel such that a portion of the first panel is not overlapped by the second panel, wherein the goods package is seated between the first panel and the second panel at least partially within the pocket, with the protruding portion of the goods package extending through the aperture, and the planar portion of the goods package abutting against the first and second panels, and a plurality of perforation lines in the first panel which divides the first panel into a first panel section, a second panel section and a third panel section, wherein the third panel section of the first panel is removed when the first panel is torn along the plurality of perforation lines to allow the goods package to be released from the packet.

2. The combination of claim 1, further comprising a third panel foldably attached to the first panel.

3. The combination of claim 1, further comprising a third panel foldably attached to the first panel, and a fourth panel foldably attached to the third panel.

4. The combination of claim 3, further comprising a panel foldably attached to the fourth panel to form an open-ended pocket.

5. The combination of claim 1, wherein the second panel is attached to the first panel by adhesive, and by a fold line.

6. The combination of claim 1, wherein the second panel is partially attached to the first panel by adhesive.

7. The combination of claim 1, further comprising a cutout in the second panel, the cutout overlapping the aperture.

* * * * *